US009435082B2

(12) United States Patent
Awi Abalo et al.

(10) Patent No.: US 9,435,082 B2
(45) Date of Patent: Sep. 6, 2016

(54) RAIL PAD WITH SEAL

(71) Applicant: HF Holding SA, Nivelles (BE)

(72) Inventors: Bolom Awi Abalo, Vilvoorde (BE); Michel Lens, Beersel (BE)

(73) Assignee: HF Holding SA, Nivelles (BE)

( * ) Notice: Subject to any disclaimer, the term of this patent is extended or adjusted under 35 U.S.C. 154(b) by 59 days.

(21) Appl. No.: 14/366,233

(22) PCT Filed: Dec. 19, 2012

(86) PCT No.: PCT/EP2012/076143
§ 371 (c)(1),
(2) Date: Jun. 17, 2014

(87) PCT Pub. No.: WO2013/092709
PCT Pub. Date: Jun. 27, 2013

(65) Prior Publication Data

US 2014/0374499 A1 Dec. 25, 2014

(30) Foreign Application Priority Data

Dec. 19, 2011 (EP) ..... 11194344

(51) Int. Cl.
*E01B 9/68* (2006.01)

(52) U.S. Cl.
CPC ..... *E01B 9/681* (2013.01); *E01B 9/685* (2013.01)

(58) Field of Classification Search
CPC ..... E01B 9/00; E01B 9/38; E01B 9/62; E01B 9/68; E01B 19/00; E01B 19/003; E01B 19/006
USPC ..... 238/264, 283, 287, 382
See application file for complete search history.

(56) References Cited

U.S. PATENT DOCUMENTS 4,971,247 A * 11/1990 Harkus ..... E01B 9/18 238/283

FOREIGN PATENT DOCUMENTS

| | | |
|---|---|---|
| AT | 398591 | 12/1994 |
| DE | 1223862 | 9/1966 |
| GB | 854063 | 11/1960 |

* cited by examiner

*Primary Examiner* — R. J. McCarry, Jr.
(74) *Attorney, Agent, or Firm* — Reinhart Boerner Van Deuren P.C.

(57) ABSTRACT

An elongate rail pad (20) for providing continuous support of a rail has a top face (201) and a bottom face (201), wherein the top face (201) is formed with a plurality of spaced apart longitudinal grooves (201). A longitudinal seal (23) against water and dirt is provided on the top face (201) at each lateral end (204). The seal (23) comprises, when considered from the lateral end, a successive arrangement of a first longitudinal lip (231), a first longitudinal channel (233), a second longitudinal lip (232), and a second longitudinal channel (234), in that order, wherein the first lip (231) projects above the top face (201), and the first and second channels (233,234) have a cross sectional size large enough to allow, in use, water that oozes in to flow throughout the channel, and the thickness (T2) of the second lip (232) is smaller than the spacing (W) between the second channel (234) and an adjacent first groove.

21 Claims, 5 Drawing Sheets

RAIL PAD WITH SEAL

The present invention is related to resilient rail pads, in particular for rails for crane systems.

Rails of this type are typically continuously supported throughout their length by a resilient pad interposed between the base of the rail and a generally steel soleplate or other support such as a steel girder. The soleplate lies on a concrete foundation or grout and provides for load distribution over the foundation. The rails are secured by rail clips fixed to the soleplate or to the girder. The resilient rail pads absorb and distribute the point loads acting on the rail when a wheel of the crane passes by.

Rail pads of the above kind are known from GB 854063, which describes to form the pads as sheets of a resilient material. In a first example, to be used under slightly oily conditions, the pad is formed with a number of shallow longitudinal grooves on both the upper and lower surfaces. A pair of adjacent V-shaped oil sealing ridges are provided close to each edge of the pad and at coincident positions on both the upper and lower surfaces. When the pad is liable to lubrication and there is hence considerable oil spillage, GB 854063 describes to form the top face of the sheet with a multiplicity of grooves arranged close together to provide an effective seal against the ingress of unwanted lubrication and at the same time to provide more biting edges to give grip against lateral spreading. The under face is the same as in the first example.

With such pads, it has been observed that the multiplicity of grooves do not provide effective sealing, since at each passage of the crane, the pad is elastically deformed, which causes a pumping effect sucking water and dirt between the rail and the pad, and possibly between pad and soleplate. The water and dirt accumulate in the grooves and when the pad is loaded, the grooves are compressed thereby pressing the dirt and water on the top faces of the ridges in between grooves. The dirt forms hard spots causing high point stresses in the rail at each passage of the crane. This leads to fatigue cracks causing early failure of the rail system.

AT 398591 describes a rail pad, in particular for tramway rails, wherein the top face is provided with a number of spaced apart ridges extending longitudinally to provide support for the rail. On the outermost ridges, narrow upward projecting lips are provided for rejecting dirt.

The continuous increase in lifting and handling capacity, particularly in ports, has led to the installation of higher crane systems enabling the handling of larger loads, which furthermore move at higher speeds. Since the number and size of the crane wheels cannot be increased proportionally, this has led to a significant increase in the load per crane wheel, which may exceed 100 tonnes. Furthermore, material savings and therefore weight reduction of the crane has led to an increase of the flexibility of the crane structure. These issues lead to increased and novel excitation modes of the rail system. It has been observed that the cranes do not only cause compression of the rails, but increasingly also rotation (torsion) about a longitudinal (horizontal) axis of the rail. With these novel excitation modes, former sealing solutions result to be ineffective.

It follows that the AT 398 591's pad provides a poor support for rails of the above type, since the rail, in unloaded condition, will almost uniquely be supported at its edges by the lips. This leads to increased deformation when a crane passes, and consequently to early failure of the rail system. Such a rail pad is therefore not suited for crane systems.

It is therefore an aim of the present invention to provide a rail pad, in particular for rails for crane systems, which is effective as seal against the intrusion of water and dirt, yet provides an optimal support of the rail.

According to the invention, there is hence provided a rail pad as set out in the appended claims. The rail pad is elongate and is at least in part made of a resilient material. It provides for continuous support of a rail. The pad has a top face and a bottom face, wherein the top face is formed with a plurality of spaced apart longitudinal grooves. A longitudinal seal against water and dirt is provided on the top face, at each lateral end.

According to the invention, the seal comprises, when considered from the lateral end, a successive arrangement of (in the given order): a first longitudinal lip, a first longitudinal channel, a second longitudinal lip, and a second longitudinal channel. The lips and channels are formed as follows. The first lip projects above the top face. The first and second channels have a cross sectional size large enough to allow, in use, water that oozes in to flow throughout the channel. The thickness of the second lip is smaller than the spacing between the second channel and an adjacent first groove. The latter provision allows for obtaining a smaller flow resistance from the second channel towards the first channel than compared to towards the grooves.

Such a seal can effectively prevent any oozing of water beyond the second channel, since the channels are large enough to allow for distributing the seeped water through them and since the second lip being smaller compared to the groove spacing not only prevents that water oozes further inwards into the pad, but also helps in expelling any seeped water back towards the first channel.

Advantageously, the first lip is coincident with a lateral edge of the pad. Alternatively, or in addition, the first lip can have an asymmetrical cross sectional shape with thickness asymmetrically decreasing towards the top, the majority of the thickness decrease being effected at the side of the first channel. Any of these provisions contribute to letting the first lip naturally bend laterally outwards, which eases the expelling of water.

Further advantageous aspects of the invention are set out in the appended dependent claims.

Aspects of the invention will now be described in more detail with reference to the appended drawings, wherein.

Figure 1:
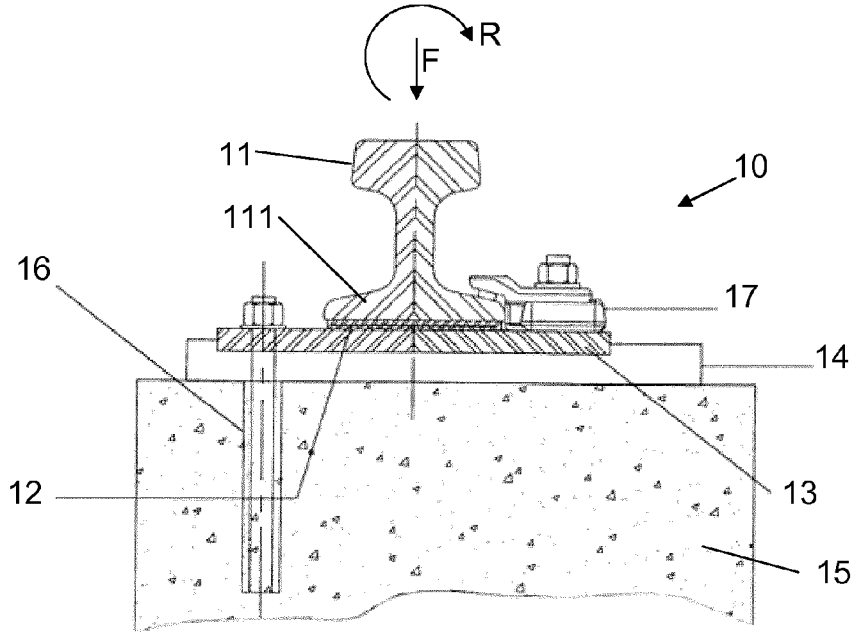
FIG. 1 represents a cross sectional view of a typical rail system for overhead cranes.

FIG. 1 represents a sectional view of a typical rail system assembly for crane systems, such as in ports and other sites using lifting and handling equipment. In such a rail system 10, the rail 11 is supported at its base or flange 111 and throughout its length by a resilient pad 12, referred to as a rail pad. Rail pad 12 forms an elastic layer between the rail 11 and a steel soleplate 13, which is provided on a grout anchorage 14 and concrete foundation 15 and fastened thereto by anchor bolts 16. The rail pad 12 may be as wide as the base 111 of the rail. The soleplate 13 withstands the concentrated load from rail 11 and pad 12 and distributes it over a larger area on the foundation 14, since concrete is mostly too soft to bear such high point loads. The rail 11 and the pad 12 are secured to the soleplate 13 by rail clips 17, which clamp the base 111 of the rail 11 and the pad 12 on the soleplate 13. A similar configuration applies to other suitable supports, such as steel girders.

Crane rail systems require not only to withstand high compressive loads F, but also, increasingly, to withstand high torsion loads R causing a rotation of the rail 11 around a horizontal axis parallel with the rail. Due to such rotation, the load on the pad 12 tends to shift towards the one or the other side, with the rail clips 17 experiencing increasing release excitation. Additionally, the support itself, for instance the aisles of the girders, may bend because of the offset between the rail and the web of the girder or between the wheel and the rail head axis, and create conditions for rail rocking and water ingress.

Figure 6:
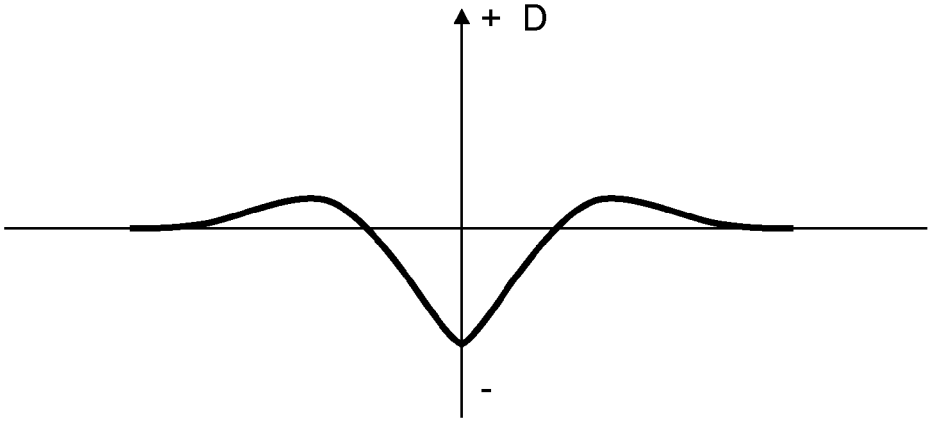
FIG. 6 represents the deformation D of a rail around the contact of a wheel, which resembles a bow wave and is therefore also called a bow wave effect. The position of the vertical axis coincides with the position of the wheel contact on the rail.

Moreover, since deformation of the rail in front and at the rear of a wheel is constricted by the rail clips, the deformation resembles a bow wave, as represented in FIG. 6. The vertical axis in FIG. 6 coincides with the position of the wheel contact on the rail. One can see that there are areas at both sides of the wheel, where the rail deformation is positive, and the rail is hence lifted. In the past, such deformation was completely absorbed by the rail pad. However, considering the tendency to dimension rails at the limit of the capacity for obvious economic reasons, it is observed that the bow wave effect is no more compensated by the compression of the rail pad, so that the rail may lift from the pad, facilitating water ingress.

It is therefore of paramount importance that the rail pad ensures an effective seal against the oozing of water and dirt between the pad and the rail in all circumstances. The present invention addresses this issue by providing the seal with improved resistance to oozing.

Figure 2:
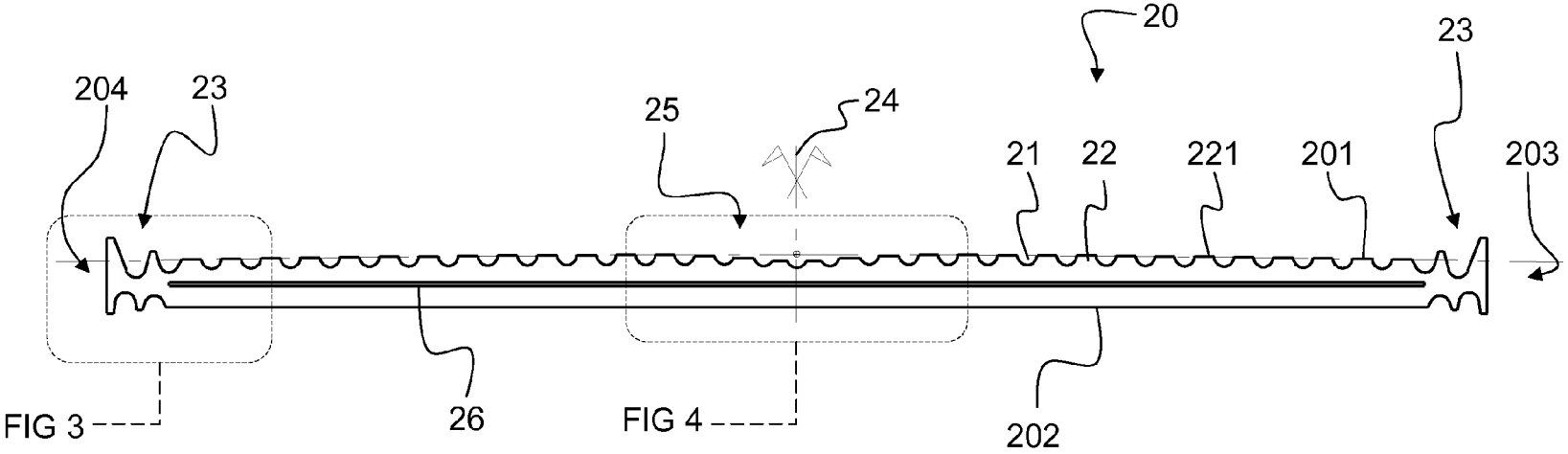
FIG. 2 represents a cross sectional or side view of a rail pad according to an example embodiment of the invention.

FIG. 2 shows a sectional or side view of a rail pad 20 according to the invention. Pad 20 is formed as a sheet with a top face 201 and an opposite under or bottom face 202. A rail 11 is arranged to be seated on the top face 201, while pad 20 rests with the under face 202 on e.g. a soleplate 13.

A multiplicity of longitudinal grooves 21 of preferably semicircular or rounded cross shape are formed on the top face 201 and preferably extend over the entire length of the pad. The grooves 21 are preferably regularly spaced apart. Ridges 22 formed in between the grooves 21 feature a preferably smooth and possibly flat top face 221. The top face can of course be adapted to the shape of the bottom face of the base of the rail. By way of example, the rail pad of FIG. 2 has a slightly convex top face 201 and the top face 221 of the ridges is adapted thereto. The size of the grooves 21 will ensure that under loading, the interposed ridges 22 can effectively dilate sideways into the grooves 21.

The under face 202 is advantageously flat, but can alternatively be grooved.

Figure 3:
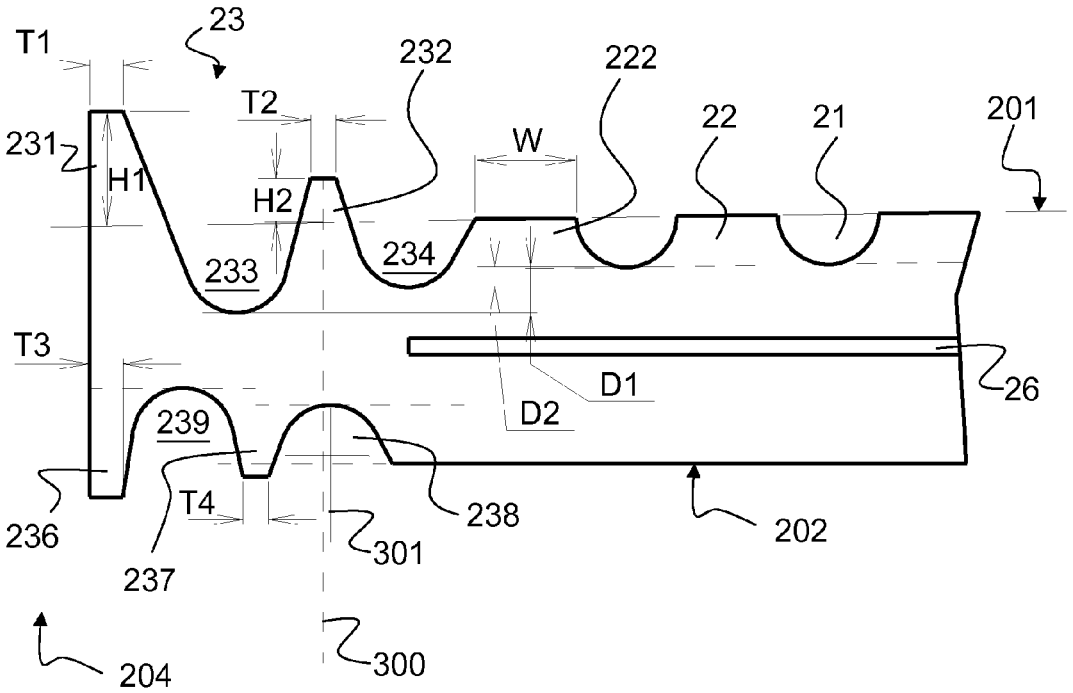
FIG. 3 is an enlarged view of a lateral end of FIG. 2's pad.

Pad 20 comprises on the top face, at each lateral end 203, 204 a seal 23 extending longitudinally throughout the length of the pad and which is shown in greater detail in FIG. 3. Seal 23 is formed of preferably two (possibly more) successive lips 231 and 232, both extending longitudinally and being alternated by channels 233 and 234 respectively. Lips 231 and 232 form ridges advantageously elevated until above the top face 201.

The outermost lip 231 is higher than the top face 201, advantageously by an amount H1 of at least 1 mm, advantageously at least 1.5 mm, advantageously at least 2 mm (measured vertically along a median line through lip 231, from a reference line or surface of the top face 201). This allows maintaining effective contact with the under face of the rail, even when the rail is lifted during deformation. Lip 231 is advantageously elevated until above the innermost lip 232.

Lip 231 is advantageously provided at the edge of the pad (on top face 201), which helps in letting the lip 231 naturally bend laterally outward when the rail is placed on top.

An alternative or additional way to advantageously improve the above effect is by an appropriate design of the sectional shape of outermost lip 231, such that it naturally bends laterally outward when the rail is placed on top. Advantageously, this is achieved as shown in FIG. 3, by making the lip 231 thinner towards the top. Advantageously, the cross sectional shape of the lip presents an asymmetry or skewness, such that it predominantly bulges or has increased thickness (when considered top-down) at the inner side (side of channel 233). As shown in FIG. 3, the outer side wall of lip 231 is about vertical, whereas the inner side wall (at the side of channel 233) has a softer inclination.

However, a mere contact between rail and lip 231 may not be sufficient for an effective seal. To this end, the invention provides for the addition of at least one inner lip 232 and for the alternation of lips 231 and 232 with channels 233 and 234.

Channels 233 and 234, which alternate the lips 231 and 232, have a cross sectional size which is large enough to allow the water that has oozed in to freely flow longitudinally throughout the channel. This means that the sizes of channels 233 and 234 must be large enough such that they are not squeezed to full obstruction by the resilient material of the pad dilating sideways when the pad is compressed under loading conditions. The channels must maintain in use a sufficiently large open section to allow water to freely flow through it.

Such sufficiently large channels allow for relieving any pressure that water, which has seeped or oozed in, may locally exert when the pad is compressed. Indeed, should the channel be too small, then this water cannot evacuate sufficiently fast through the channel (along both sides), so that a water pressure will locally build up, which may contribute to the water oozing further towards the inside of the pad.

Hence, the channels 233 and 234 must ensure in use a sufficiently low resistance to through-flow.

Figure 7:
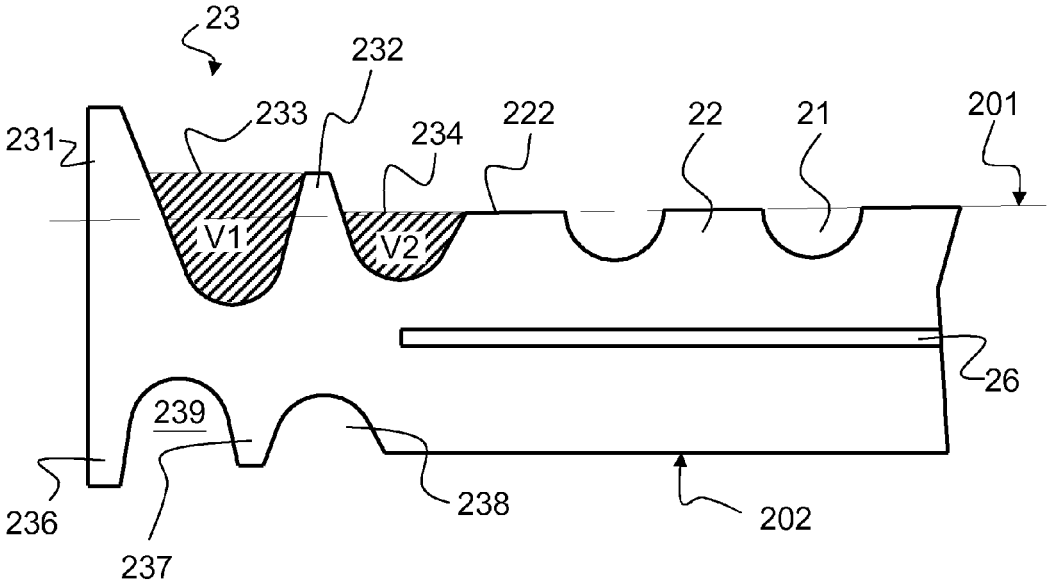
FIG. 7 represents the lateral end of FIG. 3, wherein the hatched areas V1 and V2 indicate the cross-sectional sizes of the seal's channels.

Referring to FIG. 7, channels 233 and 234 advantageously have a cross sectional size (area) V1, respectively V2 which is larger than or equal to 5 $mm^2$, advantageously larger than or equal to 6 $mm^2$. Outermost channel 233 can be larger than inner channel 234, the former having advantageously a cross sectional size (area) V1 which is larger than or equal to 7.5 $mm^2$, advantageously larger than or equal to 10 $mm^2$ (measured until the top of the lowermost bordering lip or ridge, as indicated in FIG. 7). The channels 233 and 234 advantageously have a larger size than the size of the grooves 21 (which typically measure about 3.5 $mm^2$).

The channels 233 and 234 are advantageously arranged below the top face 201. Advantageously, channels 233 and 234 have a bottom which is arranged lower than the bottom of grooves 21. Such an arrangement allows for maintaining an open section of the channels, even in the case when the grooves 21 would be completely squeezed by the resilient material under extreme loading conditions (the resilient material is compressed and dilates sideways, thereby squeezing the grooves). Referring back to FIG. 3, the bottoms of outermost channel 233 and inner channel 234 are arranged lower than the bottom of the grooves 21, or at least lower than the first groove 21 adjacent the innermost channel 234, by respective distances D1 and D2. D1 and D2 are advantageously at least 0.5 mm. Possibly, but not necessarily, D1 can be larger than D2, such as by at least 0.5 mm, so that D1 measures at least 1 mm in total and the bottom of outermost channel 233 is arranged lower than the bottom of inner channel 234.

By way of example, grooves 21 may be of semicircular cross section, with radius 1.5 mm. Inner channel 234 may be of semicircular cross section as well, with radius 2 mm. Outermost channel 233 may have same shape as inner channel 234, but the centre of radius is lowered by 0.5 mm.

Advantageously, channels 233 and 234 are wider than grooves 21, such as by an amount of at least 1 mm.

Inner lip 232, which is interposed between the channels 233 and 234, forms a second barrier against the oozed water. It may have a same height as the top face 201 (H2=0), or may alternatively be higher. Advantageously, lip 232 projects by an amount H2 of at least 0.5 mm, advantageously at least 0.75 mm, advantageously at least 1 mm above the top face 201 (measured along a median line through the lip 232).

According to an aspect of the invention, inner lip 232 is suitably thin, at least thinner than the width W of ridge 222 bordering the innermost channel 234 at the opposite side. As indicated in FIG. 3, the width W is measured between the edges of inner channel 234 and an outermost groove 21. Due to the smaller thickness T2 of lip 232 compared to the width W of ridge 222, any liquid in channel 234 will experience a lower flow resistance across lip 232 compared to across ridge 222. Such a configuration ensures that during repeated extension and compression of the pad under loading of the rail, water present in channel 234 will be biased to surmount the barrier of lip 232 and hence to flow into channel 233, instead of surmounting ridge 222 and diffuse further into grooves 21.

As a result, the seal 23 can effectively prevent any oozing of liquid beyond the inner channel 234.

As a further advantage, by providing the outer lip 231 to bend outwards as described above, it is obtained that any liquid in the outer channel 233 can easily be expelled out over the outer lip 231.

Advantageously, the thickness T2 of lip 232 and possibly T1 of lip 231 (measured at the top of the lip as shown in FIG. 3) does not exceed 0.6 times the width of ridge 222. Advantageously, the thickness T2 and possibly T1 is smaller than or equal to 4 mm, advantageously smaller than or equal to 2 mm. Advantageously, the thickness T2 is smaller than or equal to 1 mm, advantageously smaller than or equal to 0.75 mm.

In use, when the rail rests on the pad 20 and the rail base is clamped by a rail clip, the lips 231 and 232 are advantageously arranged to deform in such a way that the under face of the rail is allowed to rest on and make contact with the ridges 22.

According to a further aspect of the invention, additional resilience can be provided for the inner lip 232. This is obtained by the provision of a void space underneath the sheet at a position in correspondence of the inner lip 232. This aspect will be particularly useful in case the inner lip is elevated above the ridges 22 of the top face 201. The void space underneath allows the inner lip to be pressed downwards by the rail. The inner lip will maintain contact with the rail, since it will spring when the rail is raised by any rotation or lifting of the rail when the crane passes by.

Resilience is advantageously obtained as shown in FIG. 3, by forming a longitudinal groove or recess 238 on the under face 202 and in correspondence of the inner lip 232. The recess 238 will be advantageously delimited at the side of the lateral edge by a support lip or ridge 237 which supports he seal 23 on the soleplate. At the other side of recess 238, support is provided by the under face 202.

An additional advantage of a resilient outer lip 231, and even more a resilient inner lip 232, is that they can bias the flange or base of the rail towards the rail clip 17, and thereby ensure an all-time effective clamping force.

A second longitudinal groove or recess 239 is possibly, but not necessarily provided on the under face 202, in between recess 238 and the lateral edge. Recess 239 together with groove 233 constrict the pad between the outer and inner seal lips 231 respectively 232, thereby improving deflection of the outer lip 231. As a result, the outer lip 231 may be increased in height thereby ensuring better contact with the rail. This will not negatively affect the uniformity of rail support.

Recess 238 may induce a similar effect.

The recess 239 is advantageously delimited at the side of the lateral edge of the pad by a support ridge 236. Hence, a couple of successive support ridges 236 and 237 are created on the under face 202 by the two successive recesses 238 and 239. Ridges 236 and 237 may help to support the seal 23 on the soleplate.

Advantageously, outermost support ridge 236 projects below the under face 202, for example at least 1 mm below. Possibly, also innermost support ridge 237 projects below the under face 202, with outermost ridge 236 preferably extending below the innermost ridge 237. In such cases ridge 236 and possibly ridge 237 act as double seal against the intrusion of water and dirt between pad and soleplate. The thickness T3 and T4 of the support ridges 236, respectively 237 can be equal to the thickness T1 and T2 of the lips 231, 232. The thickness T4 can be smaller than T3.

Figure 5:
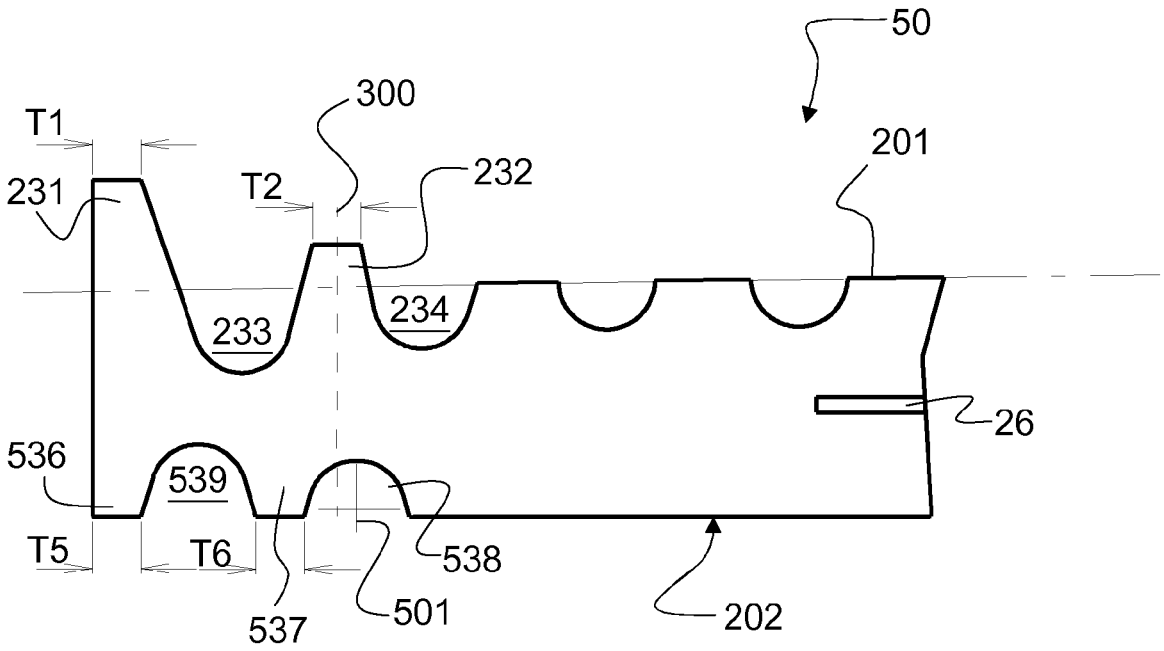
FIG. 5 represents a cross sectional or side view of a lateral end of a rail pad according to another example embodiment of the invention.

FIG. 5 shows a sectional or side view of a lateral end of another rail pad 50 according to the invention. A difference with the pad of FIGS. 2-3 is that the support ridges 536 and 537 formed by recesses 538 and 539 are coplanar with the under face 202. The thickness T5 and T6 of the support ridges 536, respectively 537 can be somewhat larger than T3 and T4 as indicated in FIG. 3. Other features of the pad 50 remain identical and are indicated with same references.

In the latter case, where support ridges 536, 537 do not project below the under face 202, sealing of the under face 202 can be guaranteed by letting the lips 231, 232 project sufficiently above the top face 201 such that, in operation, the support ridges are pressed by the rail base and the rail clip on the underlying support, such as a soleplate.

As can be seen from FIGS. 3 and 5, there need not be an exact correspondence between the median planes 300 and 301, 501 of respectively the inner seal lip 232 and the inner recess 238, 538 on the under face 202. Important is that more or less below the inner lip 232 a void is provided allowing for downward movement of the lip 232, due to the resilience of the pad material. By way of example, median plane 501 of recess 538 may be shifted towards the pad centre when compared to the median plane of the seal lip 232 itself.

As can be seen from FIG. 2, the top face 201, disregarding the grooves 21, can be inclined with height slightly increasing towards the pad's median plane 24. The slope can be linear or curved (convex), with angles (tangential) advantageously falling in the range from 0° to 1.2°. The shape is of course adapted to the shape of the under face of the rail base.

Figure 4:
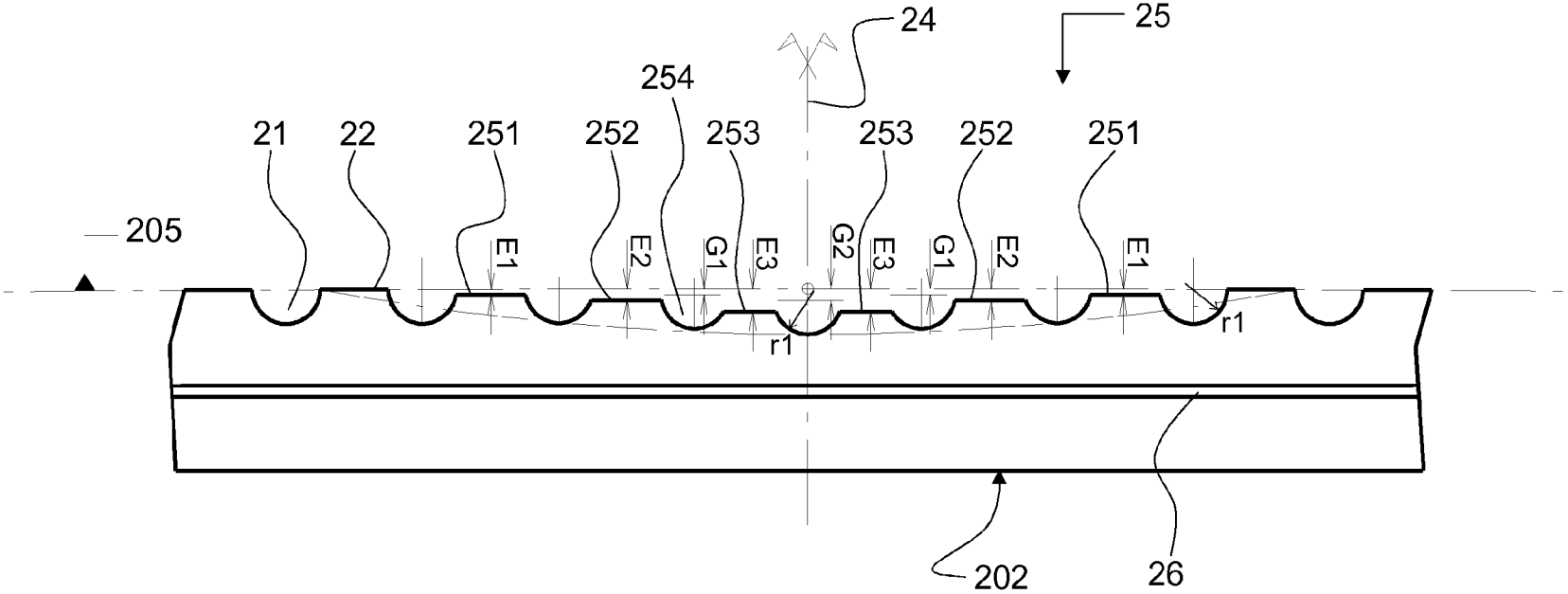
FIG. 4 is an enlarged view of a middle section of FIG. 2's pad.

In a central region 25, close and symmetrical to the median plane 24 of the pad 20, which is shown in greater detail in FIG. 4, the top face 201, disregarding the grooves 21, can be inversely inclined, with height decreasing towards the median plane 24. Ridges 251-253 disposed symmetrically with respect to the median line 24 have top faces which are arranged below the reference line 205 of the top face 201, at respective distances E1, E2, E3 increasing towards the median line 24. In other words, the pad, disregarding the grooves 21 and the seals 23, has a thickness which from the lateral ends 203, 204 initially slightly increases towards the median plane 24 to thereafter decrease in a central region 25, before the median plane 24 is reached.

In the central region 25, some grooves 254 between depressed ridges 251-253 may be lowered as well. The bottom of the grooves 254 is lowered relative to the bottom of the grooves 21 outside the central region 25. In the example of FIG. 4, the grooves have an open circular cross section with radius r1 and one can see that the centre of the radius r1 is taken at a distance G1 and G2 below the reference line 25.

The central region 25 may extend at both sides of the median plane 24 over a distance about 10% to about 30%, advantageously about 20%, of the width of the rail pad.

The above indicated shape of the top face, with inclination resembling a moustache, prevents that the rail is loaded only centrally, such as in case of a (not intended) slight convex rail under face. With the present shape of the pad, the rail is supported along two longitudinal lines or areas, which lie at both sides of the median plane 24. This allows both to absorb dimensional inaccuracies of the under face of the rail and to provide for optimal rail support during horizontal rotation (torsion) of the rail.

It is known to reinforce the pad 20, 50 by embedding a preferably steel foil 26 in the sheet of resilient material. The reinforcement 26 prevents excessive elongation of the pad under loading and advantageously extends until before the seal 23. It may as well partly extend underneath one or more seal lips 231, 232, provided that resilience and/or deformation of these lips can be ensured.

The width of the pad is determined based on the width of the base of the corresponding rail and generally corresponds to the width of the base with due account taken of the round offs at the base's edges.

Pads according to the invention are advantageously made of an elastomeric material, such as a rubber material, preferably Nitrile Butadiene Rubber (NBR) and can be manufactured either by extrusion or in a mould.

The invention claimed is:

1. A rail pad for providing continuous support of a rail, being elongate and at least in part made of a resilient material, and having a top face and a bottom face, wherein the top face is formed with a plurality of spaced apart longitudinal grooves and wherein a longitudinal seal against water and dirt is provided on the top face at each lateral end; and wherein the seal comprises, when considered from the lateral end, a successive arrangement of a first longitudinal lip, a first longitudinal channel, a second longitudinal lip, and a second longitudinal channel, in that order, wherein the first lip projects above the top face, and the first and second channels have a cross sectional size large enough to allow, in use, water that oozes in to flow throughout the channels and wherein the thickness of the second lip is smaller than the spacing between the second channel and an adjacent first groove in order to obtain a smaller flow resistance from the second channel towards the first channel than compared to towards the grooves.

2. The rail pad of claim 1, wherein the first lip is coincident with the lateral edge of the pad.

3. The rail pad of claim 1, wherein the first lip has a cross sectional shape presenting a thickness which decreases asymmetrically towards the top, such that the majority of the thickness decrease is effected at the side towards the first channel.

4. The rail pad of claim 1, wherein the first and second channels have cross sectional areas larger than or equal to 5 $mm^2$.

5. The rail pad of claim 1, wherein the first lip projects at least 1 mm above the top face.

6. The rail pad of claim 1, wherein the second lip projects above the top face.

7. The rail pad of claim 6, wherein the bottom face is so shaped as to form a longitudinal void underneath the pad at a position substantially corresponding to the second lip for allowing downward movement thereof.

8. The rail pad of claim 7, wherein the longitudinal void is formed by a first recess provided on the bottom face.

9. The rail pad of claim 8, comprising a first support ridge at the side of the first recess towards the lateral edge of the pad, for at least partially supporting the seal.

10. The rail pad of claim 9, comprising:

a second recess provided on the bottom face and interposed between the first support ridge and the lateral edge of the pad; and a second support ridge at the side of the second recess towards the lateral edge of the pad.

11. The rail pad of claim 9, wherein the first support ridge projects below the bottom face.

12. The rail pad of claim 1, wherein the top face, disregarding the grooves, is formed with a centrally arranged longitudinal depression.

13. The rail pad of claim 12, wherein the top face, disregarding the grooves and the depression, is inclined with a thickness increasing towards a vertical median plane.

14. The rail pad of claim 1, comprising a reinforcement sheet.

15. A rail assembly for crane systems, comprising the rail pad of claim 1.

16. The rail pad of claim 6, wherein the first lip projects above the second lip.

17. The rail pad of claim 10, wherein the second support ridge projects below the bottom face.

18. The rail pad of claim 14, wherein the reinforcement sheet is embedded.

19. The rail pad of claim 1, wherein the first longitudinal channel extends throughout a length of the rail pad.

20. The rail pad of claim 1, wherein the second longitudinal channel extends throughout a length of the rail pad.

21. The rail pad of claim 1, wherein the first longitudinal channel and the second longitudinal channel are open to the top face.

* * * * *